US012618300B2

(12) United States Patent
Nguyen et al.

(10) Patent No.: US 12,618,300 B2
(45) Date of Patent: May 5, 2026

(54) WELLHEAD SEALING SYSTEMS AND METHODS

(71) Applicant: CAMERON INTERNATIONAL CORPORATION, Houston, TX (US)

(72) Inventors: Dennis P. Nguyen, Houston, TX (US); Stuart Robinson, Ploiesti (RO)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 19/125,756

(22) PCT Filed: Dec. 15, 2023

(86) PCT No.: PCT/US2023/084293
§ 371 (c)(1),
(2) Date: Apr. 30, 2025

(87) PCT Pub. No.: WO2024/137391
PCT Pub. Date: Jun. 27, 2024

(65) Prior Publication Data

US 2026/0009304 A1 Jan. 8, 2026

Related U.S. Application Data

(60) Provisional application No. 63/433,796, filed on Dec. 20, 2022.

(51) Int. Cl.
*E21B 33/03* (2006.01)

(52) U.S. Cl.
CPC ..... *E21B 33/03* (2013.01)

(58) Field of Classification Search
CPC ..... E21B 33/03; E21B 33/00; E21B 33/02
See application file for complete search history.

(56) References Cited

U.S. PATENT DOCUMENTS 4,532,987 A * 8/1985 Reed ..... E21B 33/03 285/123.3
4,556,224 A * 12/1985 Le ..... E21B 33/08 277/328

(Continued)

FOREIGN PATENT DOCUMENTS

WO 2004111380 A2 12/2004

OTHER PUBLICATIONS

International Search Report and Written Opinion of International Patent Application No. PCT/US2023/084293 dated on Apr. 5, 2024, 11 pages.

*Primary Examiner* — Eugene G Byrd
(74) *Attorney, Agent, or Firm* — Kyle R. Miiller

(57) ABSTRACT

A seal assembly for sealing between a casing string and a wellhead housing is provided. In one embodiment, a system includes a seal assembly (80) received within a bore (48) of a wellhead housing (20). The seal assembly can include an elongate body (82), an inner seal (86) positioned within the elongate body to seal between the elongate body and a well casing (46), and a setting ring (88) positioned within the elongate body to apply a setting load to the inner seal to energize the inner seal between the elongate body and the well casing. The system can also include a running tool (100) having an end received within the elongate body of the seal assembly, and a piston setting assembly (110) including a piston (112) and a push sleeve (114) for setting the inner seal via the setting ring. Additional systems, devices, and methods are also disclosed.

17 Claims, 10 Drawing Sheets

(56) References Cited

U.S. PATENT DOCUMENTS

| | | | | |
|---|---|---|---|---|
| 5,257,792 | A * | 11/1993 | Putch | E21B 33/03 285/123.3 |
| 5,890,535 | A * | 4/1999 | Petrash | E21B 33/03 166/88.1 |
| 9,151,132 | B2 | 10/2015 | Nguyen | |
| 9,388,655 | B2 | 7/2016 | Sommerfeld et al. | |
| 10,161,210 | B2 | 12/2018 | Thornburrow | |
| 11,970,920 | B2 * | 4/2024 | Guidry | F16J 15/12 |
| 2004/0069493 | A1 | 4/2004 | Borak | |
| 2008/0017386 | A1 * | 1/2008 | Van Bilderbeek | E21B 33/03 166/195 |
| 2010/0126736 | A1 | 5/2010 | Ellis | |
| 2011/0169224 | A1 * | 7/2011 | Nguyen | E21B 33/03 277/336 |
| 2011/0203810 | A1 * | 8/2011 | Nguyen | E21B 33/04 166/387 |
| 2011/0316236 | A1 * | 12/2011 | Gette | E21B 33/0422 277/312 |
| 2012/0285676 | A1 * | 11/2012 | Shaw | E21B 33/04 166/88.1 |
| 2016/0069149 | A1 * | 3/2016 | Borak, Jr. | E21B 33/03 166/387 |
| 2016/0186519 | A1 * | 6/2016 | Krejci | E21B 33/04 166/75.11 |
| 2018/0073326 | A1 | 3/2018 | Nguyen | |
| 2018/0258725 | A1 | 9/2018 | Levert, Jr. | |
| 2020/0063516 | A1 * | 2/2020 | Nguyen | E21B 17/02 |
| 2022/0034184 | A1 | 2/2022 | Gonzalez et al. | |
| 2022/0243540 | A1 * | 8/2022 | Zhu | E21B 21/14 |
| 2022/0243585 | A1 * | 8/2022 | Hashim | G01M 3/223 |

* cited by examiner

WELLHEAD SEALING SYSTEMS AND METHODS

CROSS-REFERENCES TO RELATED APPLICATIONS

This application is the National Stage Entry of International Application No. PCT/US2023/084293, filed Dec. 15, 2023, which claims priority to and benefit of U.S. Provisional Patent Application No. 63/433,796 filed Dec. 20, 2022, which is hereby incorporated by reference herein in its entirety for all purposes.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various housings, casings, valves, hangers, pumps, fluid conduits, and the like, that facilitate drilling or production operations.

As will be appreciated, various tubular strings can be run into wells through wellhead assemblies. For instance, wells are often lined with casing that generally serves to stabilize the well and to isolate fluids within the wellbore from certain formations penetrated by the well (e.g., to prevent contamination of freshwater reservoirs). Such casing is frequently run into the well through a wellhead and then cemented into place.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Certain embodiments of the present disclosure generally relate to sealing between components in wellhead assemblies. In some embodiments, an emergency seal assembly is used to seal an annular space between a wellhead housing and a casing string that has become stuck while running the casing string into a well through the wellhead housing. The seal assembly can include an elongate body with an inner seal, for sealing between an inner surface of the elongate body and a casing string (or some other component received inside the elongate body), and an outer seal for sealing between an outer surface of the elongate body and a wellhead housing (or some other component surrounding the outer surface of the elongate body). The inner and outer seals may be metal seals or elastomer seals. In one embodiment, the inner seal is a metal seal that is set using a hydraulic setting tool and is locked in place by a rotational mechanism before the hydraulic setting tool is removed from the wellhead housing.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
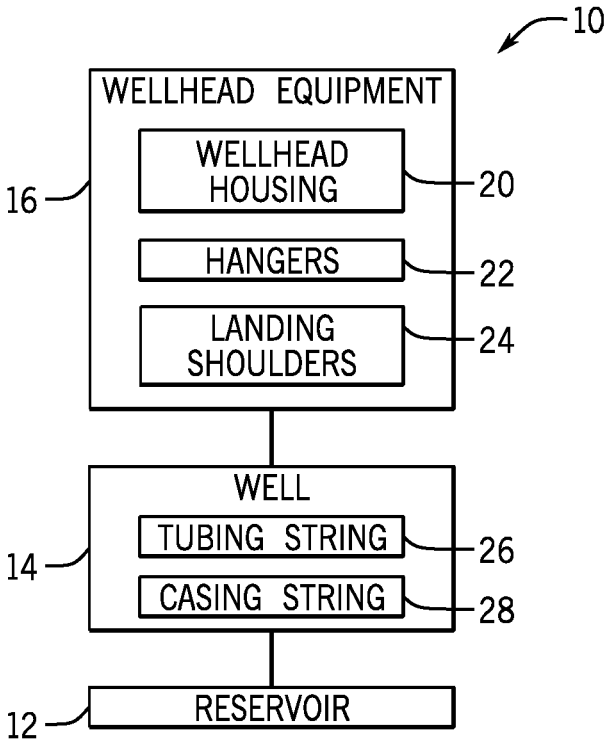
FIG. 1 generally depicts various components, including one or more tubular strings and associated hangers, that can be installed at a well in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14, such as an onshore well. Wellhead equipment 16 is installed on the well 14. As depicted, the wellhead equipment 16 includes a wellhead housing 20 and wellhead hangers 22. The wellhead housing 20 may include one or more casing heads and a tubing head in some instances. In some cases, the wellhead housing 20 includes a single-piece body designed to receive multiple hangers 22, such as a casing hanger and a tubing hanger. The hangers 22 can be mandrel-style hangers or slip-style hangers. The components of the wellhead equipment 16 can differ between applications, and could include a variety of casing heads, tubing heads, spools, housings, hangers, sealing assemblies, stuffing boxes, pumping tees, and pressure gauges, to name only a few possibilities.

The wellhead hangers 22 can be positioned on landing shoulders 24 within hollow wellhead bodies (e.g., within the wellhead housing 20). These landing shoulders 24 can be integral parts of the wellhead housing 20 or can be provided by other components, such as sealing assemblies or landing rings disposed in the wellhead housing 20. In some instances, a wellhead hanger 22 can be secured within a hollow wellhead body using a gripping device without landing the wellhead hanger 22 on a landing shoulder 24. Each of the hangers 22 can be connected to a tubular string, such as a tubing string 26 or a casing string 28, to suspend the string within the well 14. The well 14 can include a single casing string 28 or include multiple casing strings 28 of different diameters. Casing strings 28 are often cemented in place within the well. In some cases, a casing string 28 being run into a well may become stuck. If the casing cannot be pushed further into the well or pulled out, a slip hanger and emergency seal assembly may be used to suspend the casing string 28 and seal the surrounding annulus, as discussed in greater detail below.

Figure 2:
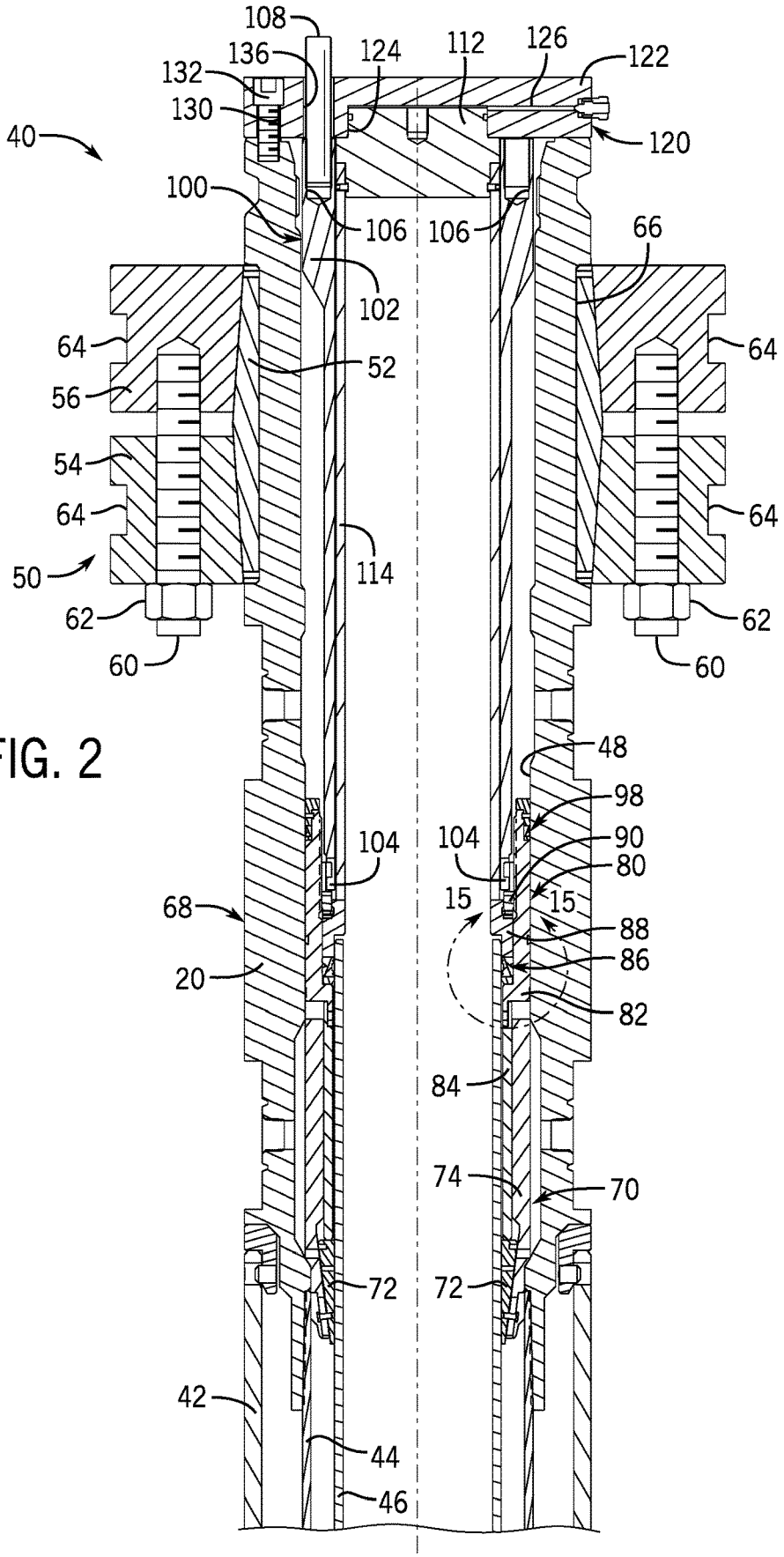
FIG. 2 is a section view of a wellhead assembly having a slip assembly, a seal assembly for sealing between a casing string and an inner surface of a wellhead housing, a running tool, and a piston setting assembly and seal flange tool for setting a seal of the seal assembly, in accordance with one embodiment.

One example of a wellhead assembly 40 is generally depicted in FIG. 2, with various components of the wellhead assembly 40 shown in greater detail in FIGS. 3-8. The assembly 40 includes a pressure-containing outer body, shown in FIG. 2 as including a hollow wellhead housing 20 with an axial bore 48. As noted above, various tubular strings can extend downwardly from the wellhead housing 20 into the well. In FIG. 2, these tubular strings include casing strings 42, 44, and 46, which may also be referred to as well casings. The tubular strings can have any suitable diameters. As depicted, the casing string 42 is a conductor casing (e.g., with a twenty-inch diameter), the casing string 44 is a surface casing (e.g., with a thirteen-and-three-eighths-inch diameter), and the casing string 46 is an intermediate casing (e.g., with a nine-and-five-eighths-inch diameter).

In some embodiments, including that shown in FIG. 2, the wellhead assembly 40 includes a clamp 50 positioned to elastically deform the wellhead housing 20 to securely grip a wellhead hanger within the bore 48. The depicted clamp 50 includes a compression ring 52, a lower energizing ring 54, and an upper energizing ring 56. These components can have any suitable form. In some embodiments, the compression ring 52 is an annular ring with one split in its circumference (i.e., a C-ring) or a segmented ring having multiple pieces (e.g., two to six pieces) to facilitate contraction of the compression ring 52 about the wellhead housing 20.

Through the tapered engagement of the compression ring 52 with the energizing rings 54 and 56, drawing the energizing rings 54 and 56 toward one another applies a radially inward compression force to the compression ring 52, which contracts and elastically deforms the wellhead housing 20 to grip a wellhead hanger positioned along the bore 48 inside the clamp 50. Although a wellhead hanger is not depicted inside the clamp 50 in FIG. 2, such a wellhead hanger could be installed and gripped inside the clamp at some other time, such as after removing running tool 100 and piston setting assembly 110 from the bore 48. The energizing rings 54 and 56 can be connected to one another in any suitable manner, such as with studs 60 and nuts 62. In some instances, the energizing rings 54 and 56 include tool recesses 64 (e.g., grooves) to facilitate use of a hydraulic tool for drawing the rings 54 and 56 together to actuate the clamp 50.

The compression ring 52 may be positioned in recessed portion 66 of the outer surface of the wellhead housing 20 to facilitate elastic deformation of the wellhead housing 20 when the clamp 50 is actuated. As shown in FIG. 2, the clamp 50 is positioned near the top of the wellhead housing 20 to elastically deform the wellhead housing 20 and grip a hanger of another tubular string, such as a hanger connected to a tubular string of a smaller diameter than the casing string 46. But the wellhead housing 20 could also or instead have a clamp 50 positioned at a different location along the housing 20, such as at location 68, for gripping a tubular string hanger.

A clamp 50 at the location 68 could be used to grip a hanger connected to the casing string 46 in some cases, but in FIG. 2 the casing string 46 is instead held within the bore 48 by a slip assembly 70. As shown in greater detail in FIG. 3, the slip assembly 70 includes slip segments 72 positioned in a slip bowl 74. The slip segments 72 are positioned circumferentially about the interior of the slip bowl 74 with some clearance between adjacent segments to facilitate radial contraction of the slip segments 72 around the casing string 46 during setting. The slip bowl 74 includes a tapered inner surface for guiding the slip segments 72 into setting engagement with the casing string 46. In some embodiments, the slip assembly 70 includes four slip segments 72, although any other suitable number of segments 72 can be used in other instances. The slip bowl 74 is landed on a shoulder within the wellhead housing 20 in FIG. 2, and the slip segments 72 securely grip the casing string 46 within the bore 48.

Figure 4:
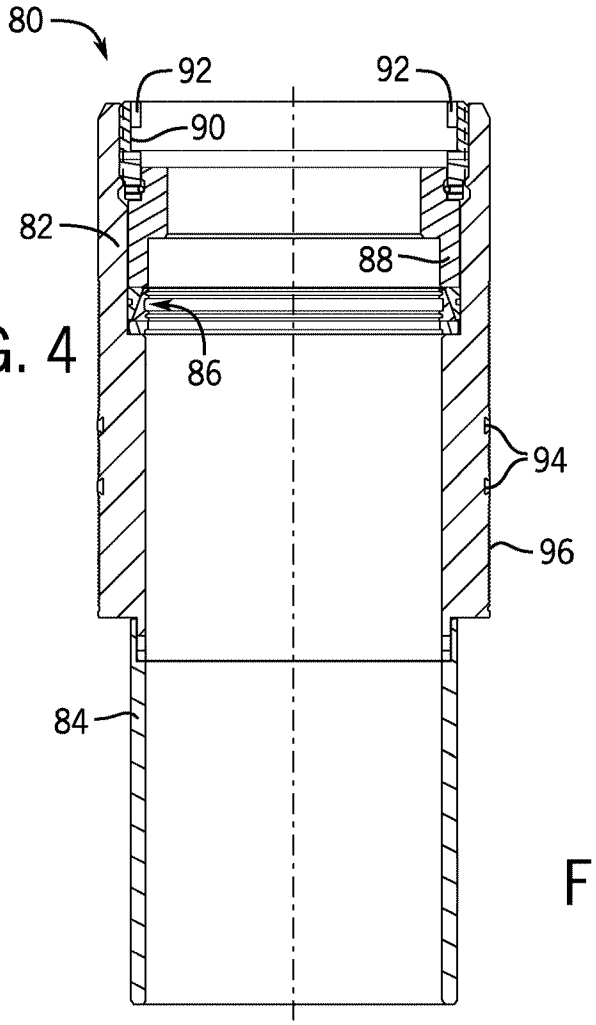
FIG. 4 is a section view of the seal assembly of FIG. 2 and shows an inner seal as a pair of mating seal rings for sealing against the casing string in accordance with one embodiment.
Figure 3:
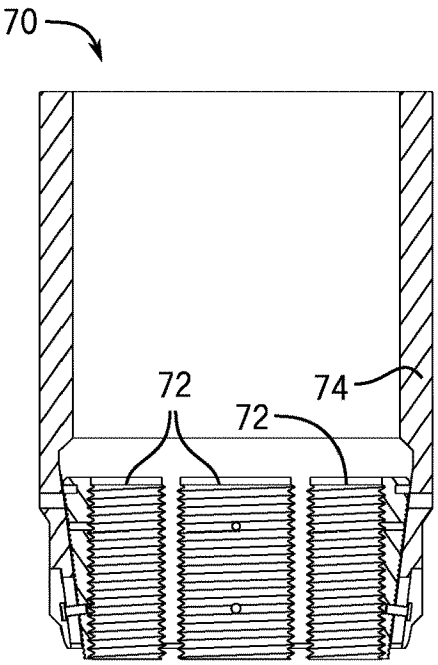
FIG. 3 is a cross-section of the slip assembly of FIG. 2 in accordance with one embodiment.

The wellhead assembly 40 of FIG. 2 also includes a seal assembly 80, which is installed in the bore 48 and is shown in greater detail in FIG. 4. The seal assembly 80 includes an elongate body 82 with a lower neck 84 and a bore to receive an end of the casing string 46, such as shown in FIG. 2. An inner seal 86 of the seal assembly 80 is positioned within the body 82 to seal between the body 82 and the casing string 46. A setting ring 88 is positioned in the body 82 to apply a setting load to the inner seal 86 to energize the inner seal 86 between the body 82 and the casing string 46.

As described in additional detail below, in some embodiments the inner seal 86 includes inner and outer seal rings that share a tapered mating interface. In the embodiment depicted in FIG. 2, for instance, the setting ring 88 can be pushed down against the outer seal ring to apply the setting load, with the engagement of the outer seal ring with the inner seal ring along the tapered mating interface causing the outer seal ring to be pushed radially outward into sealing contact with the body 82 and the inner seal ring to be pushed radially inward into sealing contact with the casing string 46. In at least some instances, the inner and outer seal rings are metal rings that provide a metal-to-metal seal between the body 82 and the casing string 46. As discussed further below, a piston setting assembly 110 can be used in some embodiments to push the setting ring 88 against the inner seal 86 to apply the setting load.

The seal assembly 80 of FIG. 2 additionally includes a retaining ring 90. In the embodiment depicted in FIGS. 2 and 4, the retaining ring 90 is threaded into the body 82. After the setting ring 88 is driven against the inner seal 86 to apply the setting load, the retaining ring 90 can be threaded down into contact with the setting ring 88 to retain the setting ring 88 in place and maintain energization of the inner seal 86. The retaining ring 90 can have radial protrusions 92 or other features to facilitate rotation of the retaining ring 90 on its threads.

The seal assembly 80 can also include annular seals along an exterior surface of the body 82. In FIG. 4, for instance, seals 94 (e.g., elastomer seal rings) are depicted along an exterior surface 96 of the body 82. Although two seals 94 are depicted in FIG. 4, some other number of seals 94 could be used, or no seals 94 used, in other embodiments. And in some instances, such as depicted in FIG. 2, an outer seal 98 can also or instead be used to seal between the exterior of the body 82 and an inner surface of the wellhead housing 20. Similar to the inner seal 86, the outer seal 98 can include inner and outer seal rings (e.g., metal seal rings) that share a tapered mating interface that causes the outer seal ring to radially expand and the inner seal ring to radially contract during relative movement of the seal rings during setting.

Figure 5:
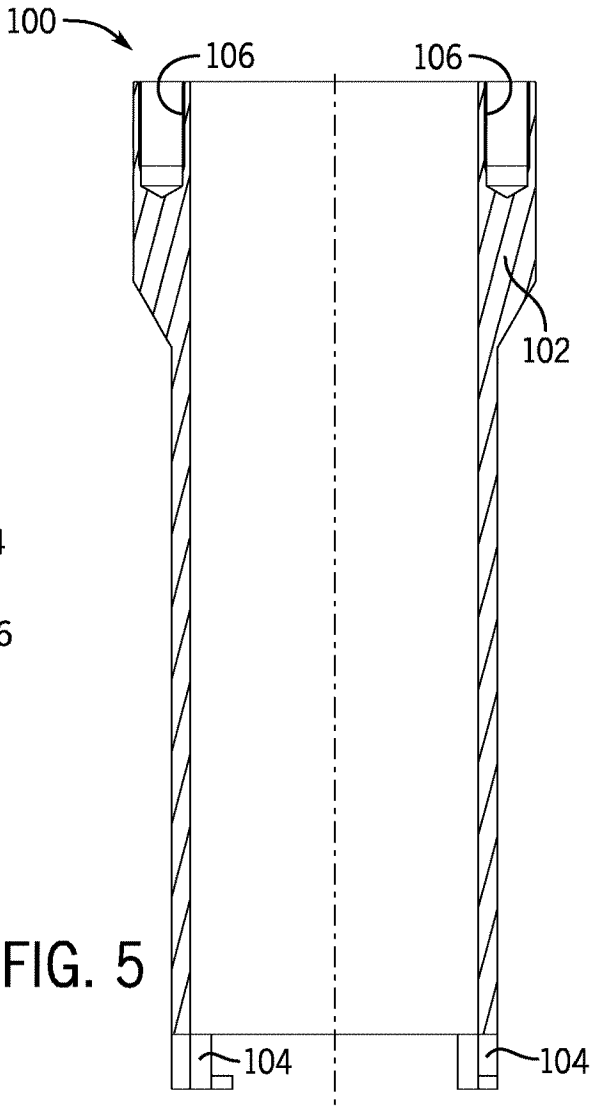
FIG. 5 is a section view of the running tool of FIG. 2 in accordance with one embodiment.

In FIG. 2, the depicted wellhead assembly 40 includes a running tool 100 to facilitate installation of the seal assembly 80. As shown also in FIG. 5, the running tool 100 includes a generally cylindrical body 102. Protrusions 104 (e.g., castellations) at the lower end of the body 102 allow the running tool 100 to engage and transmit torque to the retaining ring 90. That is, with the lower end of the running tool 100 received within the seal assembly 80, torque can be transmitted to the retaining ring 90 by rotating the running tool 100 to push the protrusions 92 and thereby rotate the retaining ring 90 on its threads. The protrusions 104 of the body 102 can have any suitable shape, but in some embodiments include a slot to receive the protrusions 92. One example of such a slot is generally depicted in the protrusion 104 on the left side of the body 102 in FIG. 5. The seal assembly 80 can be suspended from the running tool 100, such as through mating engagement of the protrusions 104 with the protrusions 92, and lowered into the bore 48 of the wellhead housing 20 via the running tool 100 in at least some instances. Although two protrusions 92 of the seal assembly 80 are shown in FIG. 4 and two protrusions 104 of the running tool 100 are shown in FIG. 5, any suitable numbers of protrusions 92 and protrusions 104 may be included in various embodiments. The upper end of the running tool body 102 includes holes 106 to facilitate rotation of the running tool 100 within the bore 48, such as discussed further below, via at least one stud 108 (FIG. 2) inserted in at least one of the holes 106. In some cases, the holes 106 are tapped holes and one or more studs 108 are threaded into the holes 106.

Figure 6:
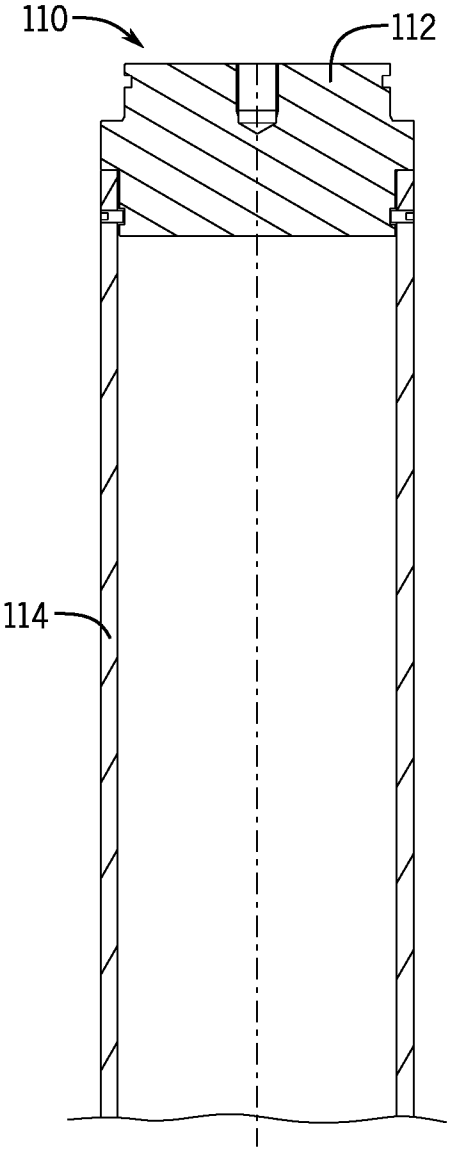
FIG. 6 is a section view of the piston setting assembly of FIG. 2 in accordance with one embodiment.

The wellhead assembly shown in FIG. 2 further includes a piston setting assembly 110, which is also shown in more detail in FIG. 6. This piston setting assembly 110 includes a piston 112 coupled to a push sleeve 114. Like the body 82 of the seal assembly 80 and the body 102 of the running tool 100, the piston setting assembly 110 can have a generally cylindrical shape. In FIG. 2, the assembly 110 is shown installed such that the push sleeve 114 is received in the bore of the running tool 100 and an end of the push sleeve 114 is received in an upper end of the body 82 of the seal assembly 80. More specifically, the push sleeve 114 is shown landed on the setting ring 88 of the seal assembly 80 in FIG. 2. In operation, the piston 112 can be actuated to drive the push sleeve 114 against the setting ring 88 to cause the setting ring 88 to apply the setting load to the inner seal 86.

Additionally, a seal flange tool 120 is shown fastened to the wellhead housing 20 above the running tool 100 and the piston setting assembly 110 in FIG. 2. As depicted in FIGS.

7 and 8, the seal flange tool 120 includes a body 122 having a recess 124. A fluid port 126 extends through the body 122 from an exterior surface to the recess 124. As shown in FIG. 2, the piston 112 of the piston setting assembly 110 is received in the recess 124. A sealing plug 128 may be removed from the body 122 and hydraulic control fluid can be routed through the fluid port 126 into the recess 124 to control movement of the piston 112. More specifically, hydraulic control fluid can be pumped into the recess 124 via the port 126 to stroke the piston 112 downward, push the sleeve 114 against the setting ring 88, and energize the inner seal 86.

Figure 7:
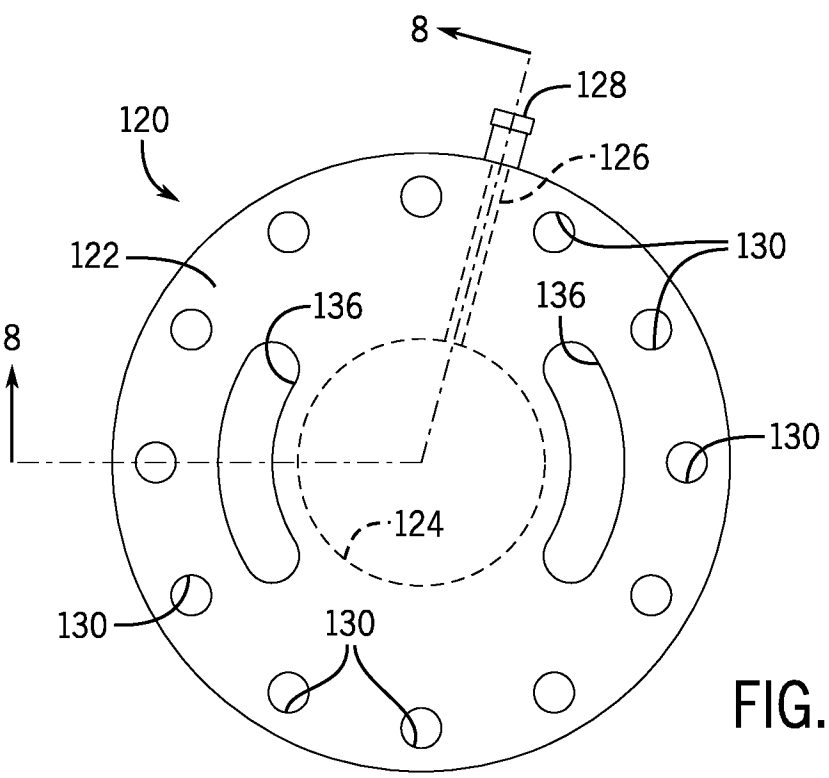
FIG. 7 is a top plan view of the seal flange tool of FIG. 2 in accordance with one embodiment.
Figure 8:
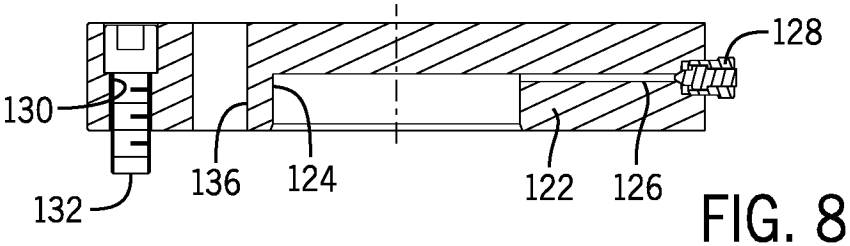
FIG. 8 is a section view of the seal flange tool of FIG. 2 in accordance with one embodiment.

The body 122 includes mounting holes 130 to facilitate connection of the body 122 to the wellhead housing 20 via fasteners 132 (e.g., cap screws). The body 122 also includes slots 136 for allowing one or more studs 108 to extend through the body 122 from the running tool 100. The slots 136 are shown in FIG. 7 as arcuate slots but could take other forms in different embodiments.

A method for installing the seal assembly 80 in the wellhead housing 20 may be better understood with reference to FIGS. 9-16. In at least some embodiments, the seal assembly 80 is installed in the wellhead housing 20 to provide a sealing barrier between the casing string 46 and the wellhead housing 20 after the casing string 46 has become stuck in the well 14. Consequently, the seal assembly 80 may be referred to as an emergency seal assembly 80 in such cases.

Figure 11:
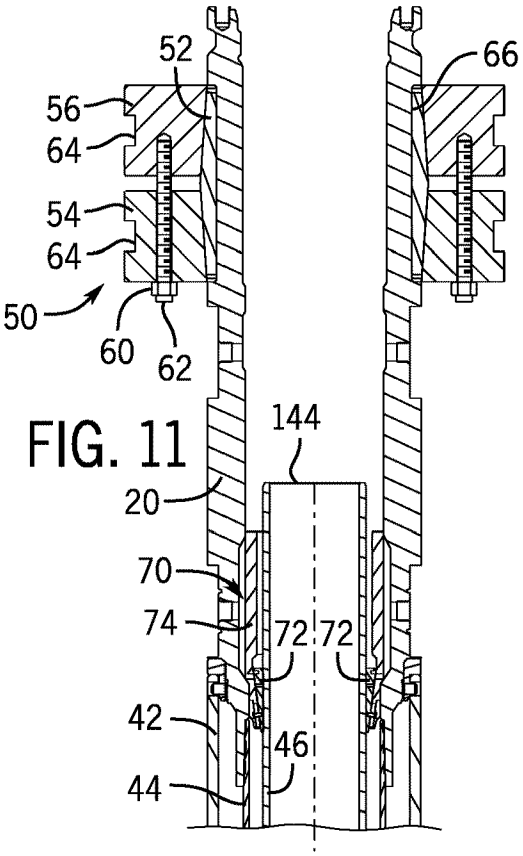
FIG. 11 is a section view of the wellhead assembly of FIGS. 9 and 10 after landing the slip assembly in the wellhead housing and cutting the casing string in accordance with one embodiment.
Figure 10:
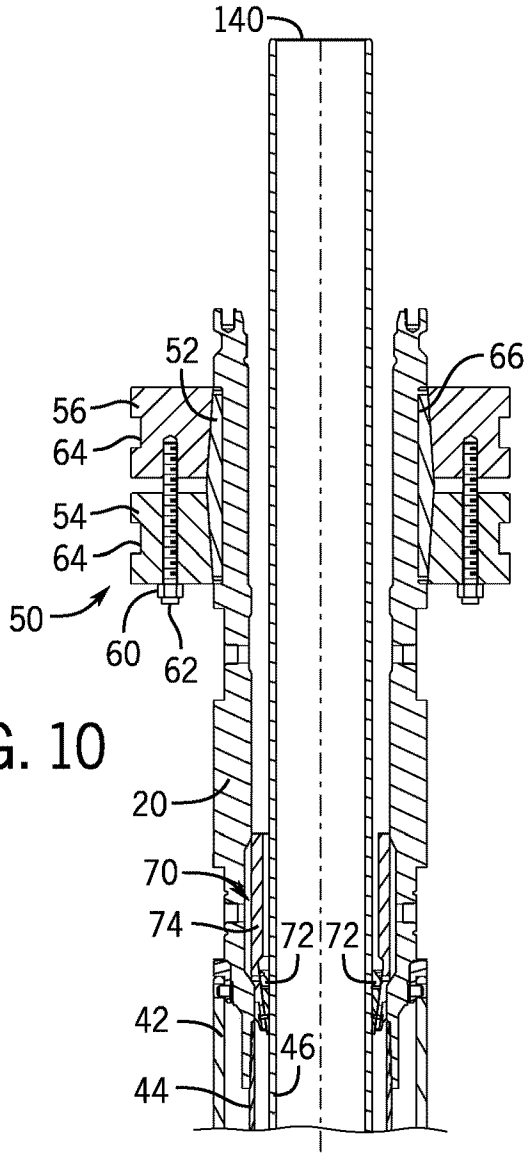
FIGS. 9 and 10 are section views of a wellhead assembly and generally depict running of the slip assembly of FIG. 2 into the wellhead housing in accordance with one embodiment.
Figure 9:
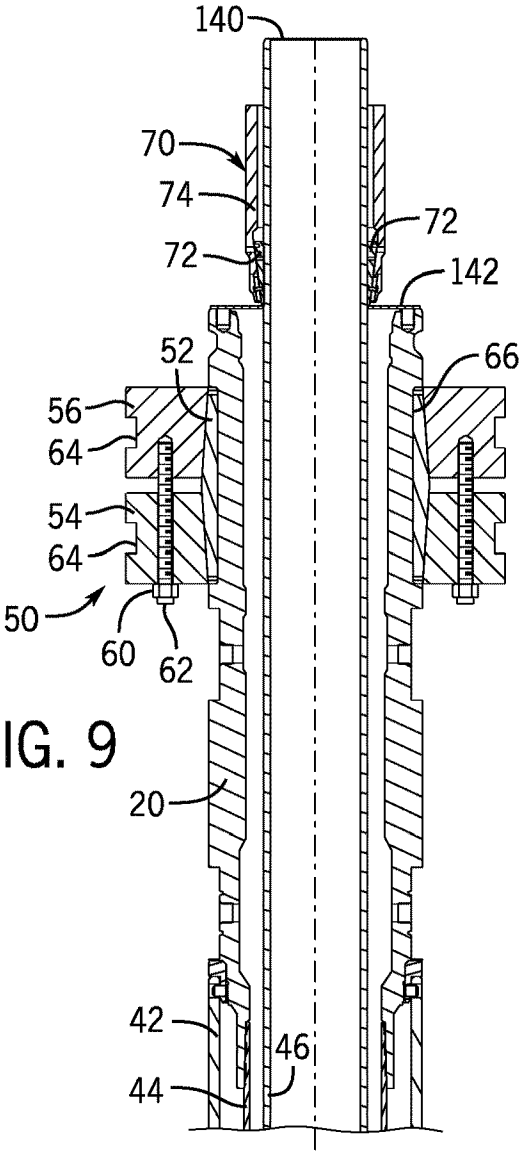

FIG. 9 shows the casing string 46 within the wellhead housing 20. The casing string 46 has an upper edge 140. In at least some embodiments, such as if the casing string 46 has become stuck in the well 14, this upper edge 140 is a temporary cut that is formed by cutting the casing string 46 to remove excess casing length above the wellhead housing 20. The slip assembly 70 may then be landed in the wellhead housing 20, such as shown in FIG. 10. The slip assembly 70 in some cases is a wrap-around slip assembly 70 that facilitates installation of the slip assembly 70 about the casing string 46 above the wellhead housing 20. During installation, the slip assembly 70 may be supported above the wellhead housing 20 by a temporary board 142, such as shown in FIG. 9, or other support structure. Once the slip assembly 70 is positioned about the casing string 46, the board 142 may be removed and the slip assembly 70 may be landed in the wellhead housing 20 and set to grip and support the casing string 46, such as shown in FIG. 10. The casing string 46 may then be cut again, which may be referred to as a final cut, to form a new upper edge 144, as shown in FIG. 11. The casing string 46 can be cut through any suitable techniques. In some instances, the casing string 46 is cut with an external cutting tool that is run into the wellhead housing 20 and cuts the casing string 46 from the exterior surface of the casing string 46 without cutting the casing string 46 from within its bore.

Figure 12:
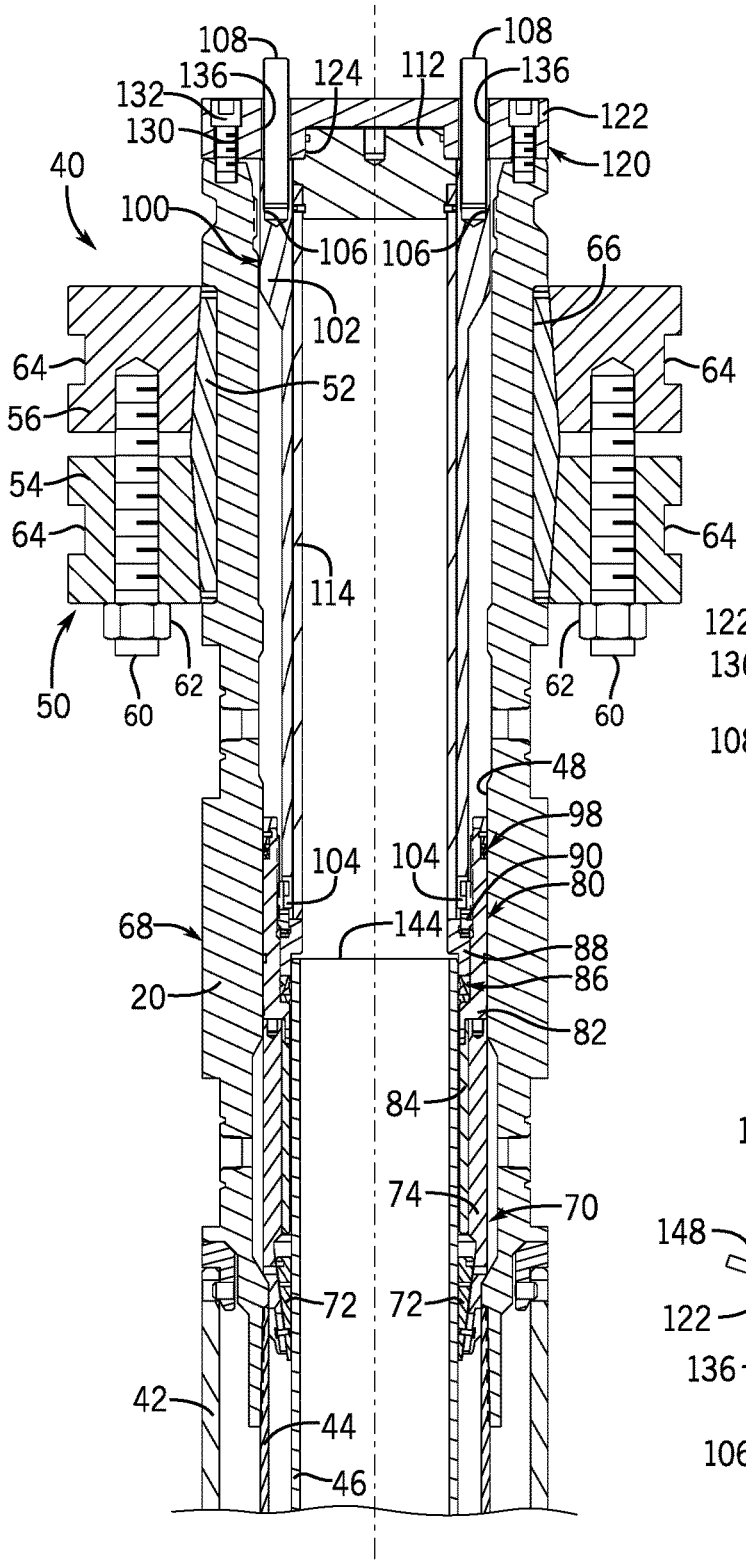
FIG. 12 is a section view of the wellhead assembly of FIG. 11 after landing the seal assembly and the piston setting assembly into the wellhead housing and fastening the seal flange tool to the wellhead housing such that studs extend from the running tool through slots in the seal flange tool body in accordance with one embodiment.

After the final cut, the seal assembly 80 and the piston setting assembly 110 can be run into the wellhead housing 20. As depicted in FIG. 12, the seal assembly 80 can be run into the wellhead housing 20 with the running tool 100 and landed on the slip assembly 70 such that the inner seal 86 is positioned radially between the casing string 46 and the body 82 of the seal assembly 80. As also shown in FIG. 12, the piston setting assembly 110 extends coaxially through the running tool 100 and is landed on the setting ring 88. The piston setting assembly 110 can be run into the wellhead housing 20 with the seal assembly 80 or in a separate step after the seal assembly 80 is landed.

After the piston setting assembly 110 is landed, the seal flange tool 120 can be made up to the upper end of the wellhead housing 20, such as depicted in FIG. 12. With the seal flange tool 120 fastened to the wellhead housing 20, the piston 112 is received in the recess 124. Control fluid (e.g., hydraulic control fluid) may then be pumped into the recess 124 through the fluid port 126 (FIGS. 7 and 8) to drive the piston 112 axially downward, which causes the push sleeve 114 to push against the setting ring 88. In this manner, the setting load can be applied to the inner seal 86 by pressurizing the recess 124. It will be appreciated that one or more seals (e.g., an elastomer seal in a circumferential groove of the piston 112) may be provided to prevent control fluid from leaking out of the recess 124 past the piston 112.

Once the inner seal 86 is set with the setting ring 88, the retaining ring 90 can be moved down toward the setting ring 88 to retain the setting ring 88 in the set position and maintain energization of the inner seal 86. In the embodiment depicted in FIG. 12, the retaining ring 90 can be threaded down into contact with the setting ring 88 using the running tool 100 to apply torque to the retaining ring 90, such as described above. More specifically, studs 108 can be installed in holes 106 of the running tool 100 through the slots 136 of the seal flange tool body 122 and used to drive rotation of the running tool 100. As shown in the top plan view of FIG. 13, the slots 136 are arcuate slots axially aligned with the upper surface of the running tool body 102 such that at least some holes 106 are accessible through the slots 136. The running tool body 102 can include any suitable number of holes 106, but six holes 106 are shown spaced circumferentially about the upper surface of the body 102 at sixty-degree intervals in FIG. 13, with two of the holes 106 carrying studs 108 (which extend through the slots 136 as shown in FIG. 12), two other holes 106 visible through the slots 136, and the two remaining holes 106 (shown in phantom in FIG. 13) covered by the seal flange tool body 122. The studs 108 extend beyond the body 122 and, by applying force to the studs 108, the studs 108 can be pushed to travel within the arcuate slots 136 and cause rotation of the running tool 100.

Figure 13:
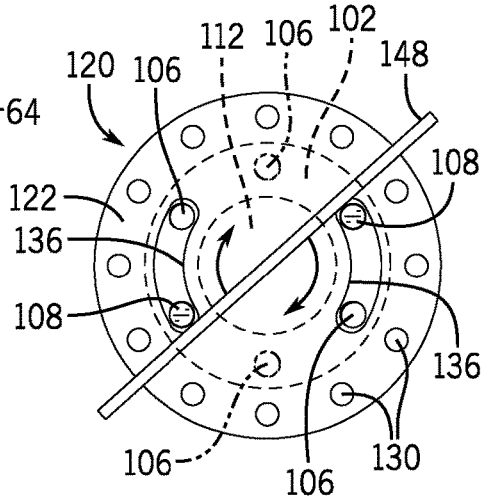
FIGS. 13 and 14 are top plan views of the seal flange tool of FIG. 12 and generally depict how the studs of FIG. 12 can be moved through arcuate slots of the seal flange tool body to rotate the running tool within the bore of the wellhead housing in accordance with one embodiment.
Figure 14:
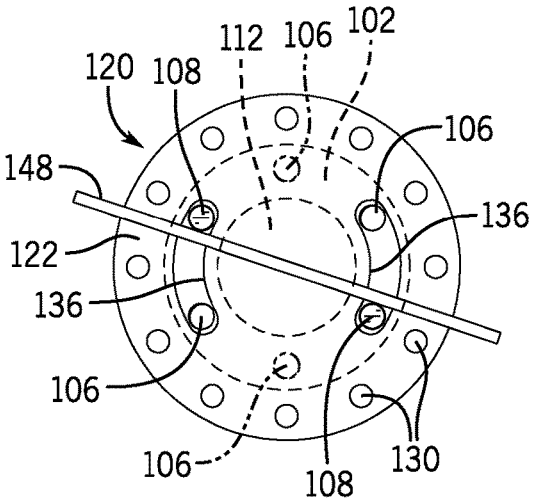

The motive force on the studs 108 can be applied in any suitable fashion, such as with a bar 148 spanning the two studs 108. As generally represented by arrows in FIG. 13, the bar 148 can be rotated clockwise to push the studs 108 through the arcuate slots 136 from the positions shown in FIG. 13 to the positions shown in FIG. 14, which would cause the running tool 100 to rotate clockwise sixty degrees. Although the arcuate slots 136 in FIGS. 13 and 14 are depicted as having a curved length allowing approximately a sixty-degree sweep of rotation of studs 108 about a rotational axis, the slots 136 could be sized differently and allow a different amount of travel of the studs 108 in other embodiments.

In some instances, the slots 136 may be long enough to allow rotation of the running tool 100 to remove slack between the retaining ring 90 and the setting ring 88 in less than one sweep of each stud 108 from one end of its slot 136 to the opposite end of the slot 136. In other instances, however, further rotation may be desired to move the retaining ring 90 into a position that maintains the setting ring 88 in a seal-energizing position. In such cases, the studs 108 can be removed from the holes 106 and reinstalled in other holes 106 accessible through the arcuate slots 136. For instance, after moving the studs 108 through the arcuate slots 136 from the positions in FIG. 13 to the positions in FIG. 14, the studs 108 can be removed from their locations depicted in FIG. 14 and reinstalled in the other holes 106 accessible through the slots 136, generally returning the studs 108 to the positions depicted in FIG. 13 (relative the arcuate slots 136). The studs 108 could then be pushed along the slots 136 again to drive further rotation of the running tool 100 and the retaining ring 90. This repositioning of studs 108 and further rotation may be repeated as needed to move the retaining ring 90 into a position that secures the setting ring 88 to maintain setting load on the inner seal 86.

Figure 15:
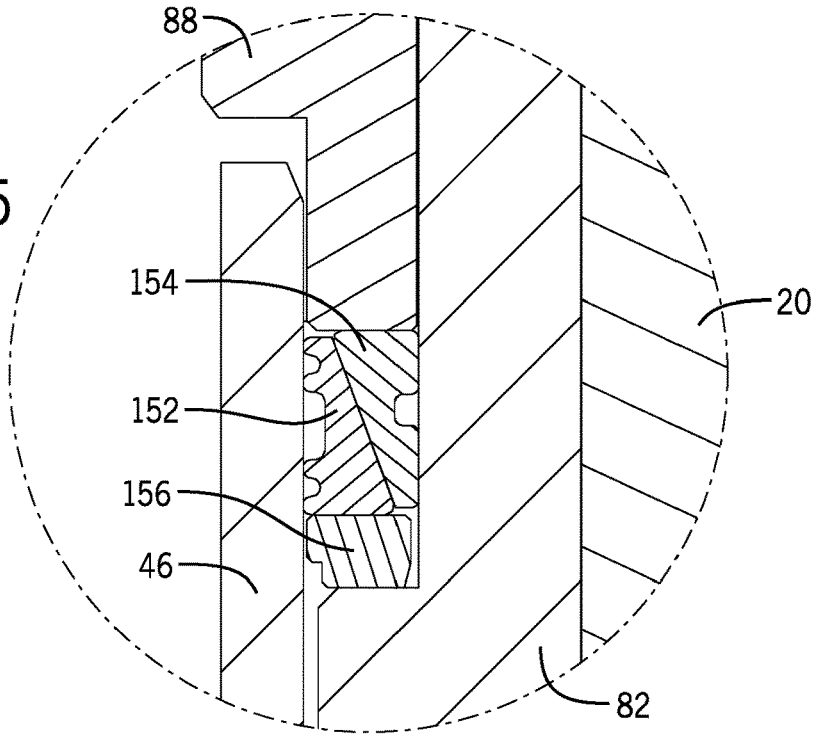
FIG. 15 is a detail view of the inner seal of the seal assembly of FIGS. 2 and 12 and depicts the inner seal as mating seal rings in accordance with one embodiment.
Figure 16:
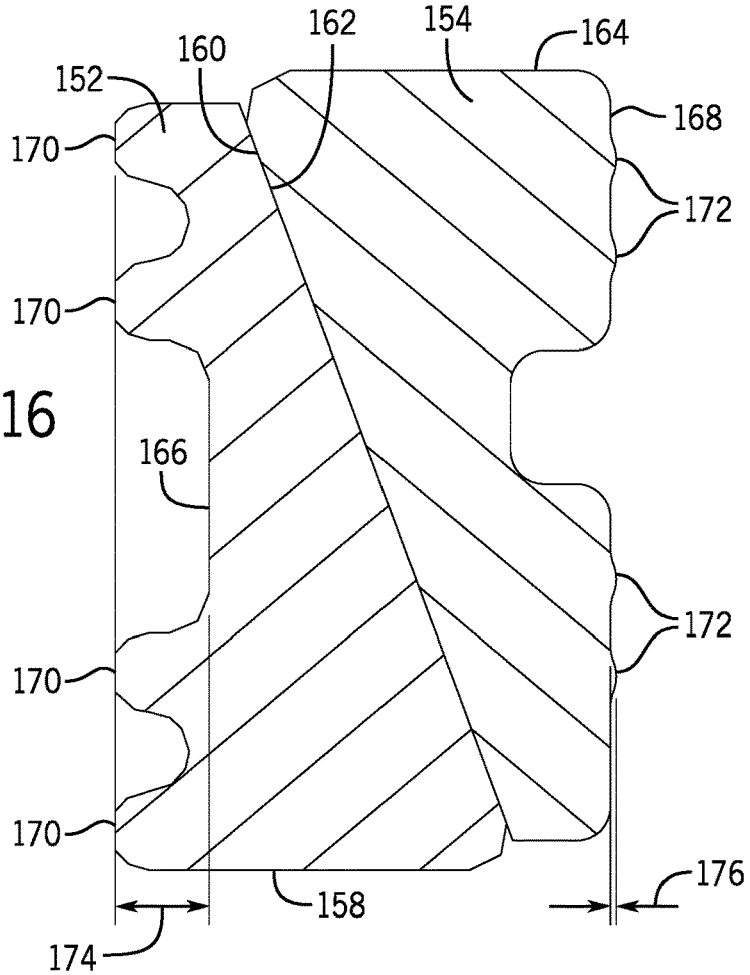
FIG. 16 is a cross-section of a portion of the mating seal rings of FIG. 15 in accordance with one embodiment.

Details of the inner seal 86 are shown in greater detail in FIGS. 15 and 16 in accordance with one embodiment. The inner seal 86 is depicted in FIGS. 15 and 16 as having an inner seal ring 152 and an outer seal ring 154. These seal rings 152 and 154 are metal rings in at least some embodiments and provide metal-to-metal sealing against the casing string 46 and the body 82 of the seal assembly 80. The inner seal ring 152 is supported by a backing ring 156 in FIG. 15, with a lower radial surface 158 (FIG. 16) resting on the backing ring 156. The seal rings 152 and 154 share a mating interface along tapered surfaces 160 and 162. When a setting load is applied, the setting ring 88 pushes an upper radial surface 164 of the seal ring 154, driving the outer seal ring 154 against the inner seal ring 152 along their shared interface. The taper of this interface causes the outer seal ring 154 to be pushed radially outward to seal against the body 82 of the seal assembly 80 and the inner seal ring 152 to be pushed radially inward to seal against the casing string 46.

As shown in FIG. 16, the inner seal ring 152 includes an inner circumferential face 166 and the outer seal ring 154 includes an outer circumferential face 168. Circumferential ridges 170 protrude inwardly from the inner face 166 of the inner seal ring 152 by a distance 174. These ridges 170 reduce the area of contact and enhance sealing contact pressure between the inner seal ring 152 and the casing string 46. The outer seal ring 154 can also include circumferential ridges 172 extending outwardly from the outer face 168 by a distance 176 to facilitate sealing against the body 82 of the sealing assembly 80. But in at least some embodiments, including that depicted in FIG. 16, the distance 176 by which the ridges 172 protrude from the outer face 168 is much less than the distance 174 by which the ridges 170 protrude from the inner face 166. For example, the distance 176 may be less than fifteen percent, less than ten percent, or less than five percent of the distance 174. This allows the outer face 168 to be positioned more closely to the body 82 of the sealing assembly.

During setting, the outer face 168 of some embodiments acts as a stop surface (e.g., an annular surface that is flat in an axial dimension) that limits radial expansion of the outer seal ring 154. This causes more of the setting load to be transferred to a radially inward compressive force on the inner seal ring 152 toward the casing string 46 during energization, which can reduce the total setting load needed to set the inner seal, reduce the setting distance of the inner seal, better accommodate sealing against an uneven or tilted casing string 46, and allow more uniform energizing of the inner seal. In other embodiments, the protrusions 172 may be omitted, with the outer face 168 limiting radial expansion of the outer seal ring 154 like described above.

Figure 17:
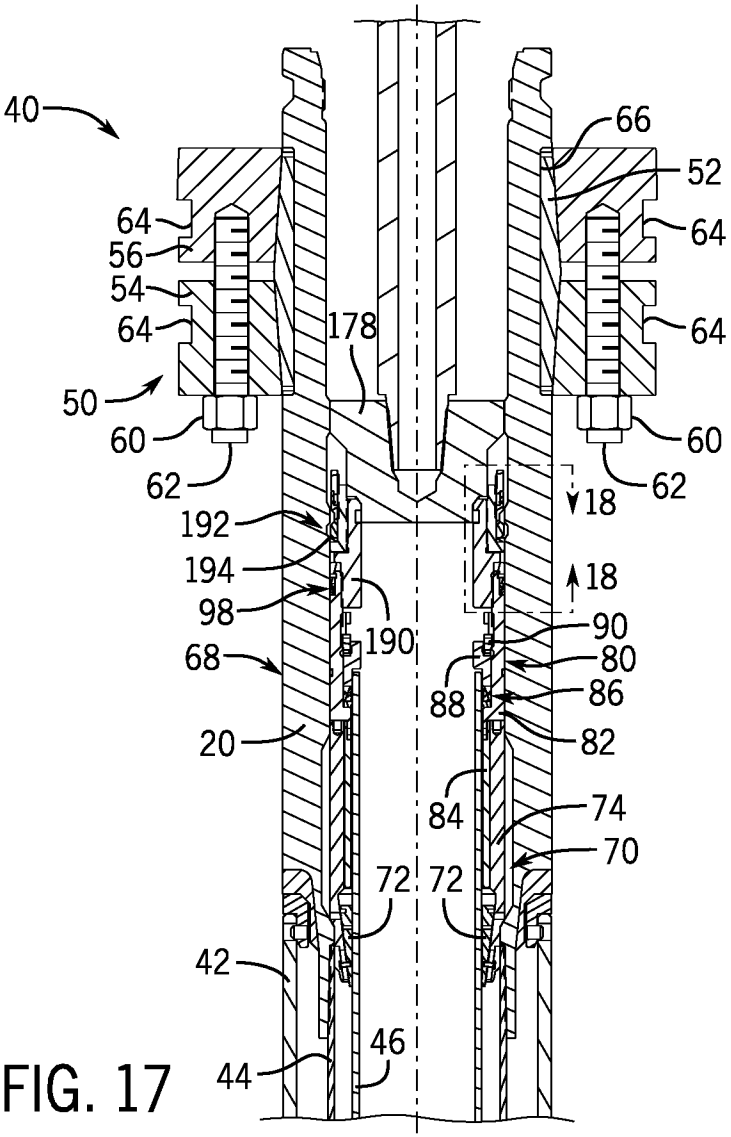
FIG. 17 is a section view of the wellhead assembly of FIG. 12 after removing the running tool, the piston setting assembly, and the seal flange tool, and also after running a locking assembly into the wellhead housing with a running tool, in accordance with one embodiment.

With the inner seal 86 set and the retaining ring 90 positioned to maintain energization of the inner seal 86, the seal flange tool 120 may be disconnected and the running tool 100 and piston setting assembly 110 can be removed from the wellhead housing 20. The outer seal 98 may then be set between the outer surface of the body 82 of the seal assembly 80 and the inner surface of the wellhead housing 20. As shown in FIG. 17, a running tool 178 can be used to run a locking assembly 192 into the wellhead housing 20 and set the outer seal 98. In some cases, the outer seal 98 may have been run into the wellhead housing 20 with the body 82 of the sealing assembly. In other cases, the outer seal 98 can be run into the wellhead housing 20 at some later time, such as with the running tool 178 after the inner seal 86 has been set.

Figure 18:
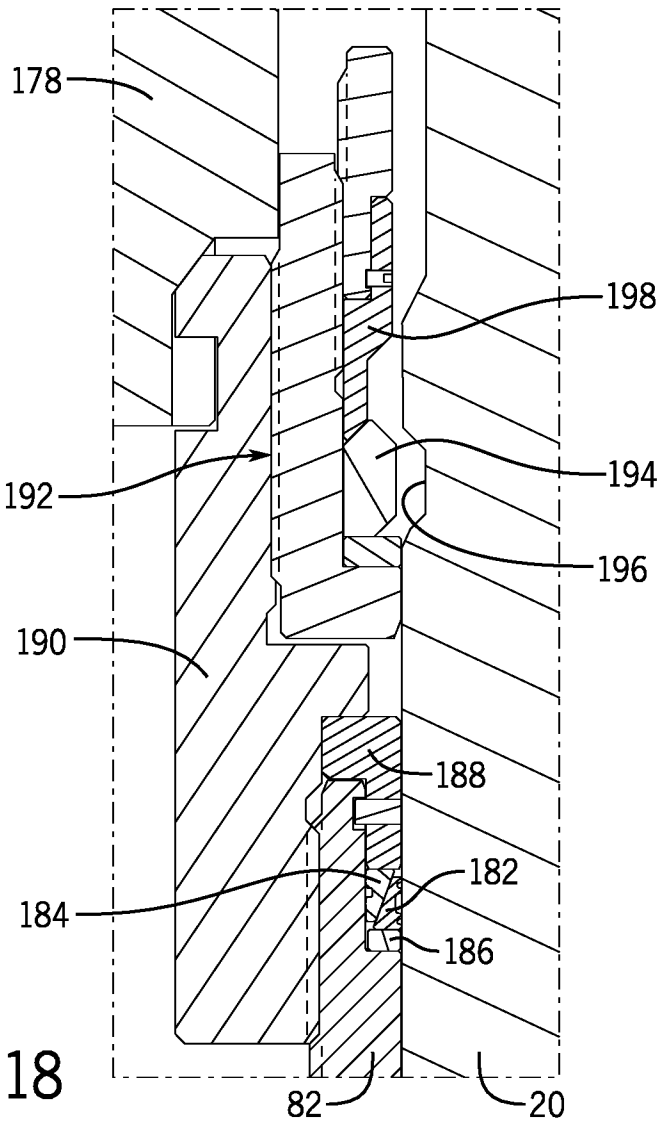
FIG. 18 is a detail view of the locking assembly of FIG. 17 and an outer seal of the seal assembly, with the outer seal provided as mating seal rings, in accordance with one embodiment.

Additional details of the outer seal 98 and the locking assembly 192 are shown in FIG. 18 in accordance with one embodiment. In this example, the outer seal 98 includes an outer seal ring 182 and an inner seal ring 184 positioned over a backing ring 186. These seal rings 182 and 184 may be substantially similar to the seal rings 152 and 154 described above for the inner seal 86 (e.g., metal sealing rings with a mating tapered surface), but are shown in FIG. 17 with switched orientations. That is, in FIG. 18, it is the inner ring 184 configured with a stop surface that limits radial contraction of the inner seal ring 184 and causes more of the setting load on the outer seal to be transferred to a radially outward expansion force on the outer seal ring 182 to enhance sealing against the wellhead housing 20. It will be appreciated that the seal rings 152, 154, 182 and 184 are not limited to use in sealing between a casing string and a wellhead housing; rather such seal rings may be used in other applications to provide a metal-to-metal seal in an annular space between two components. Although the outer seal is depicted as a mating pair of seal rings 182 and 184 in FIGS. 17 and 18, other seals may be used. In another embodiment depicted in FIG. 19, for instance, the outer seal 98 is a metal end cap seal 202 having an annular elastomer body with metal end caps provided along its upper and lower surfaces.

Figure 20:
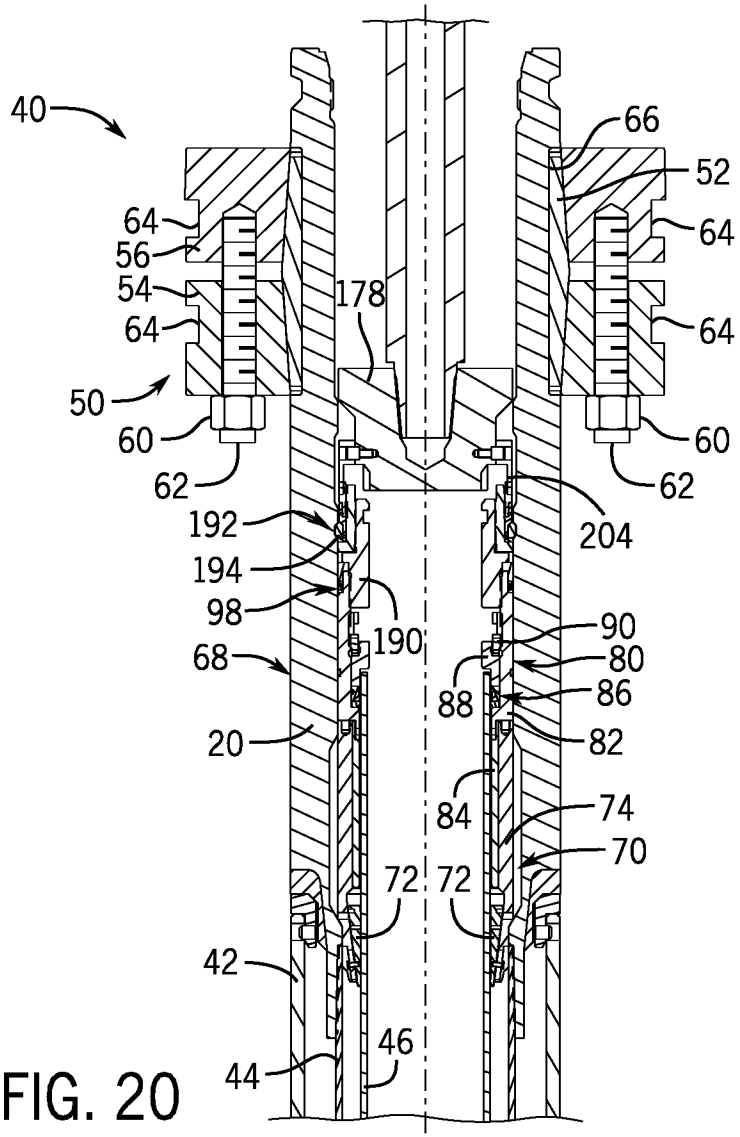
FIG. 20 is a section view of the wellhead assembly of FIG. 17 after securing the locking assembly in place within the wellhead housing in accordance with one embodiment.
Figure 19:
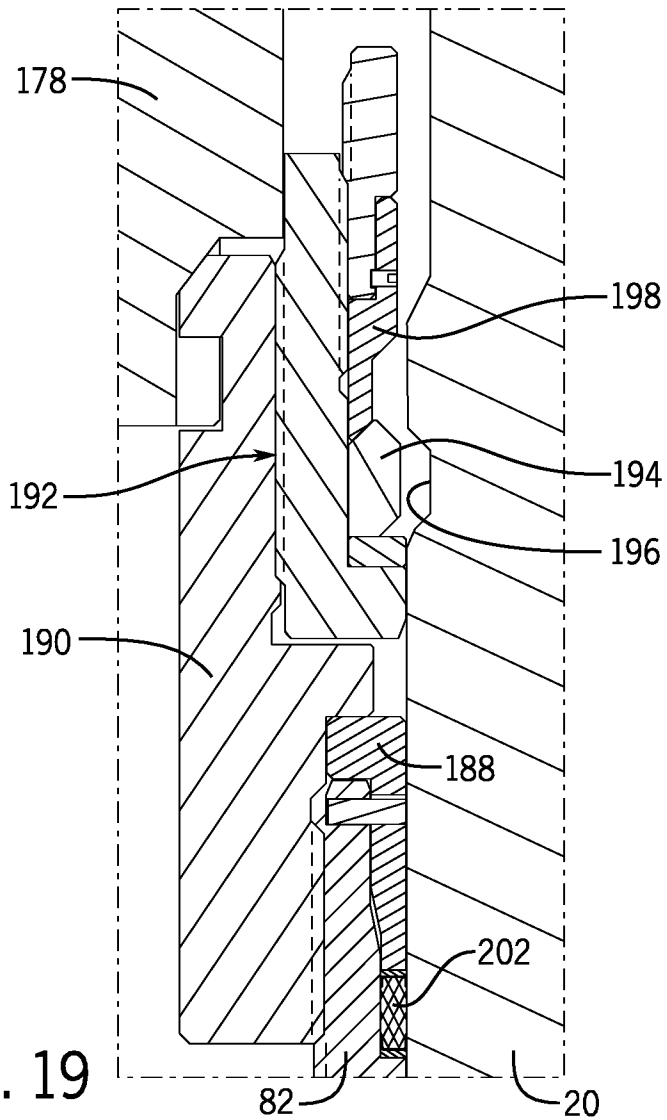
FIG. 19 is a detail view similar to FIG. 18 but in which the outer seal is provided as a metal end cap seal in accordance with one embodiment.
Figure 21:
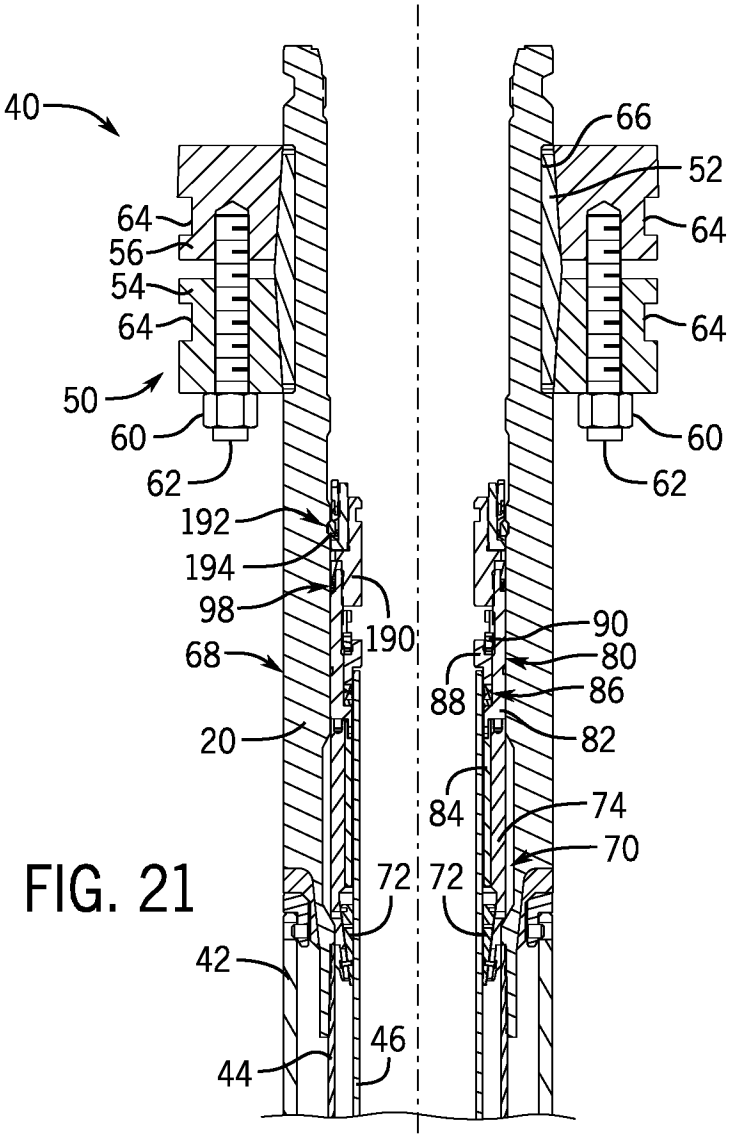
FIG. 21 is a section view of the wellhead assembly of FIG. 20 after removing the locking assembly running tool from the wellhead housing in accordance with one embodiment.

In the embodiments of FIGS. 18 and 19, a push ring 190 bears against the setting ring 188 to apply a setting load to the outer seal. The running tool 178 can be rotated to thread the push ring 190 downward and increase load on the setting ring 188. As also shown in FIGS. 18 and 19, the locking assembly 192 includes a lock ring 194 (e.g., an inwardly biased C-ring) and a setting ring 198 for pushing the lock ring 194 into a mating circumferential groove 196 of the wellhead housing 20 to secure the locking assembly 192 and the seal assembly 80 within the bore of the wellhead housing 20. Some other positive lock mechanism may be used in other embodiments, such as wedge operated dog segments, to secure the assembly 192 and other components within the wellhead housing 20. After the outer seal 98 is set, the outer seal 98 may be preloaded and the locking assembly 192 may be engaged by driving the setting ring 198 behind the lock ring 194 to push the lock ring radially outward into the groove 196, such as shown in FIG. 20. An interface sleeve 204 may be fastened to the running tool 178 and used to move the setting ring 198 down behind the lock ring 194. After locking the locking assembly 192 within the bore, the running tool 178 may be removed from the wellhead housing 20 to leave the wellhead assembly as depicted in FIG. 21.

Figure 22:
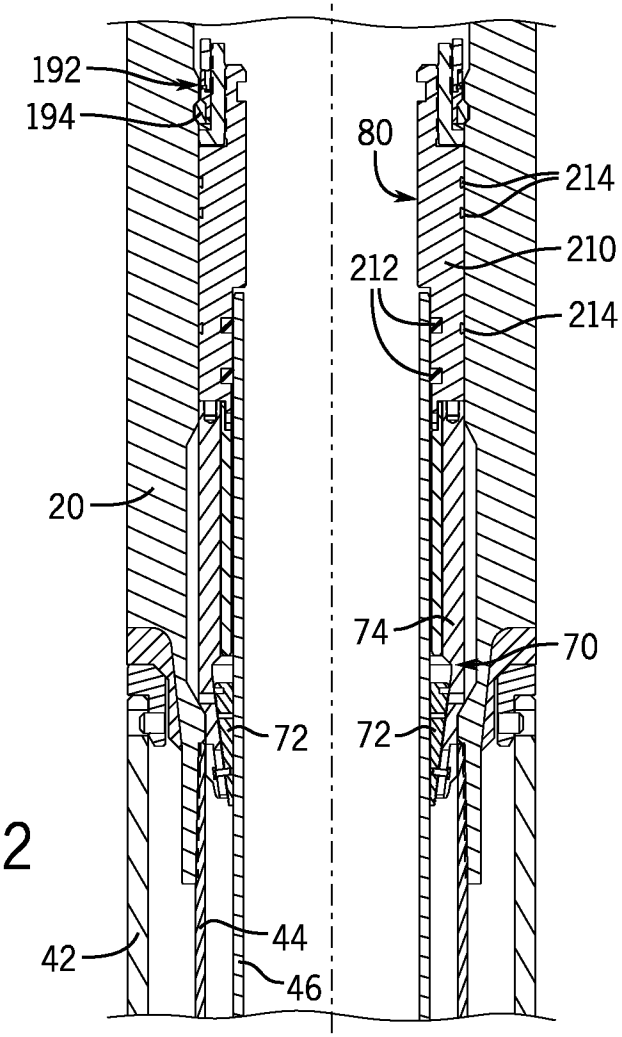
FIG. 22 is a section view of a wellhead assembly in which a seal assembly having elastomer seals is used to seal an annular space between a casing string and a wellhead housing in accordance with one embodiment.

Although the inner seal 86 and the outer seal 98 of the seal assembly 80 may be provided as metal sealing rings, such as those described above, in other embodiments elastomer seals may be used for one or both of the inner seal 86 and the outer seal 98. By way of example, a sealing assembly 80 is depicted in FIG. 22 as having an elongate body 210 with elastomer seals 212 and 214. The elastomer seals 212 seal between the elongate body 210 and the casing string 46, and the elastomer seals 214 seal between the elongate body 210 and the wellhead housing 20. Any suitable numbers and types of seals may be used with the sealing assembly 80 to seal the annular space between the casing string 46 and the wellhead housing 20.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a seal assembly configured to be received within a bore of a wellhead housing, the seal assembly including:

an elongate body having a bore to receive an end of a well casing within the wellhead housing;

an inner seal positioned within the elongate body to seal between the elongate body and the well casing when the seal assembly is received within the bore of the wellhead housing; and a setting ring positioned within the elongate body to apply a setting load to the inner seal to energize the inner seal between the elongate body and the well casing;

a running tool having a bore and an end that is sized to be received within the elongate body of the seal assembly;

a piston setting assembly including a piston and a push sleeve, wherein the push sleeve is sized to be received in the bore of the running tool, includes an end configured to be received within the elongate body of the seal assembly, and is configured to be driven by the piston to push the setting ring and cause the setting ring to apply the setting load to the inner seal; and a seal flange tool configured to be fastened to an end of the wellhead housing, wherein the seal flange tool includes a body with an arcuate slot configured such that, following receipt of the running tool within the wellhead housing and fastening of the seal flange tool to the end of the wellhead housing, the arcuate slot is axially aligned with an upper surface of the running tool.

2. The system of claim 1, comprising a stud configured to be received by the running tool and extend through the arcuate slot of the seal flange tool to facilitate rotation of the running tool within the wellhead housing by applying force to the stud to cause the stud to travel within the arcuate slot.

3. The system of claim 1, wherein the body of the seal flange tool includes a recess configured to receive the piston of the piston setting assembly and includes a hydraulic fluid port to allow hydraulic control fluid to be pumped into the recess to control movement of the piston.

4. The system of claim 1, wherein the inner seal includes an inner seal ring and an outer seal ring that share a tapered mating interface such that, during energization of the inner seal, movement of the outer seal ring and the inner seal ring relative to one another along the tapered mating interface causes the outer seal ring to be pushed radially outward and the inner seal ring to be pushed radially inward.

5. The system of claim 4, wherein the outer seal ring includes an outer face, and wherein the inner seal ring includes an inner circumferential ridge protruding from an inner face of the inner seal ring.

6. The system of claim 5, wherein the outer face includes a stop surface configured to limit radial expansion of the outer seal ring and increase a compressive force on the inner seal ring during energization.

7. The system of claim 6, wherein the outer seal ring includes an outer circumferential ridge protruding from the outer face of the outer seal ring.

8. The system of claim 7, wherein the inner circumferential ridge protrudes radially inward from the inner face by a first distance, the outer circumferential ridge protrudes radially outward from the outer face by a second distance, and the second distance is less than fifteen percent of the first distance.

9. The system of claim 1, wherein the inner seal is an elastomer seal.

10. The system of claim 1, wherein the seal assembly includes an outer seal positioned to seal between the elongate body and the wellhead housing when the seal assembly is received within the bore of the wellhead housing.

11. The system of claim 10, wherein the outer seal includes an inner seal ring and an outer seal ring that share a tapered mating interface such that, during energization of the outer seal, movement of the outer and inner seal rings of the outer seal relative to one another along their shared tapered mating interface causes the outer seal ring of the outer seal to be pushed radially outward and the inner seal ring of the outer seal to be pushed radially inward.

12. The system of claim 10, wherein the outer seal includes elastomer.

13. The system of claim 1, comprising a slip assembly configured to be received within the bore of the wellhead housing and to receive an end of the elongate body.

14. The system of claim 1, comprising the wellhead housing, wherein the seal assembly is installed within the bore of the wellhead housing.

15. A method of installing a seal assembly in a wellhead housing, the method comprising:

landing a seal assembly in a bore of a wellhead housing via a running tool, the seal assembly including: an elongate body having a bore to receive an end of a well casing within the wellhead housing, an inner seal positioned within the elongate body, and a setting ring positioned within the elongate body;

landing a piston setting assembly in the wellhead housing, the piston setting assembly including a piston and a push sleeve;

after landing the piston setting assembly in the wellhead housing, fastening a seal flange tool to the wellhead housing such that an arcuate slot in a body of the seal flange tool is axially aligned with an upper surface of the running tool;

stroking the piston to apply a setting load to the inner seal via the push sleeve and the setting ring such that the setting load energizes the inner seal between the elongate body and the well casing;

after applying the setting load to the inner seal, rotating the running tool to move a retaining ring against the setting ring; and removing the running tool and the piston setting assembly from the wellhead housing, wherein stroking the piston to apply the setting load to the inner seal via the push sleeve and the setting ring includes pumping hydraulic control fluid through a port in the body of the seal flange tool to move the piston; and wherein rotating the running tool to move the retaining ring against the setting ring includes applying force to a stud that extends from the running tool through the arcuate slot of the seal flange tool to move the stud along the arcuate slot and drive rotation of the running tool.

16. The method of claim 15, comprising:

after applying force to the stud that extends from the running tool through the arcuate slot of the seal flange tool to move the stud along the arcuate slot, removing the stud from the running tool;

positioning the stud at a different location of the running tool such that the stud extends through the arcuate slot; and after positioning the stud at the different location of the running tool, applying force to the stud to move the stud along the arcuate slot and drive further rotation of the running tool.

17. The method of claim 15, comprising setting an outer seal between the wellhead housing and the elongate body of the seal assembly.

* * * * *